US009387671B2

(12) United States Patent
Masui

(10) Patent No.: US 9,387,671 B2
(45) Date of Patent: Jul. 12, 2016

(54) HEAD DRIVING DEVICE, RECORDING HEAD UNIT, AND IMAGE FORMING APPARATUS

(71) Applicant: Naruhiro Masui, Kanagawa (JP)

(72) Inventor: Naruhiro Masui, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/695,493

(22) Filed: Apr. 24, 2015

(65) Prior Publication Data

US 2015/0328886 A1 Nov. 19, 2015

(30) Foreign Application Priority Data

May 14, 2014 (JP) ..... 2014-100867

(51) Int. Cl.
*B41J 29/38* (2006.01)
*B41J 2/045* (2006.01)

(52) U.S. Cl.
CPC ..... *B41J 2/04581* (2013.01); *B41J 2/04506* (2013.01); *B41J 2/04563* (2013.01); *B41J 2/04586* (2013.01); *B41J 2/04588* (2013.01); *B41J 2/04593* (2013.01)

(58) Field of Classification Search
CPC .. B41J 2/04541; B41J 2/04548; B41J 2/0457; B41J 2/04581; B41J 2/0459; B41J 2/04598
See application file for complete search history.

(56) References Cited

U.S. PATENT DOCUMENTS

| | | | | |
|---|---|---|---|---|
| 6,149,263 | A | 11/2000 | Nakano | |
| 7,234,788 | B2 * | 6/2007 | Gardner | B41J 2/04508 347/10 |
| 7,637,584 | B2 | 12/2009 | Takata | |
| 2004/0261700 | A1 | 12/2004 | Edwards et al. | |
| 2007/0206234 | A1 | 9/2007 | Ozasa et al. | |
| 2011/0164273 | A1 | 7/2011 | Masui | |
| 2011/0221739 | A1 | 9/2011 | Masui | |
| 2013/0265354 | A1 | 10/2013 | Watanabe | |
| 2014/0111570 | A1 | 4/2014 | Nitta et al. | |

FOREIGN PATENT DOCUMENTS

| | | |
|---|---|---|
| JP | 10-138475 | 5/1998 |
| JP | 4764690 | 6/2011 |
| WO | WO 02/098576 A1 | 12/2002 |

OTHER PUBLICATIONS

Extended European Search Report issued Oct. 9, 2015 in Patent Application No. 15165917.4.

* cited by examiner

*Primary Examiner* — Julian Huffman
(74) *Attorney, Agent, or Firm* — Oblon, McClelland, Maier & Neustadt, L.L.P

(57) ABSTRACT

The invention is concerning a head driving device that drives a recording head including a plurality of nozzles and a plurality of pressure generating elements corresponding to the respective nozzles. The head driving device comprises: a plurality of drive waveform generating units corresponding to the respective pressure generating elements, wherein the drive waveform generating units drive the respective pressure generating elements on the basis of pieces of drive waveform information that are set for the respective nozzles so as to approximately equalize ejection characteristics of droplets ejected from the nozzles.

12 Claims, 8 Drawing Sheets

HEAD DRIVING DEVICE, RECORDING HEAD UNIT, AND IMAGE FORMING APPARATUS

CROSS-REFERENCE TO RELATED APPLICATIONS

The present application claims priority to and incorporates by reference the entire contents of Japanese Patent Application No. 2014-100867 filed in Japan on May 14, 2014.

BACKGROUND OF THE INVENTION

1. Field of the Invention

The present invention relates to a head driving device, a recording head unit, and an image forming apparatus.

2. Description of the Related Art

As an image forming apparatus, such as a printer, a facsimile machine, a copier, or a digital printer, there is a known image forming apparatus of a liquid ejection recording system (for example, an inkjet recording apparatus) that uses a recording head including a liquid ejection head (droplet ejection head) for ejecting ink droplets, for example. The image forming apparatus of the liquid ejection recording system ejects ink droplets from the recording head onto a recording medium (for example, a sheet of paper) to form a desired image.

The recording head includes a nozzle for ejecting ink droplets, an ink channel (pressure chamber) communicating with the nozzle, and a pressure generating means that pressurizes ink in the ink channel. As the recording head, a so-called piezoelectric type, a thermal type, an electrostatic type, and the like are generally known. A piezoelectric type recording head uses a piezoelectric element (for example, a piezo element) as the pressure generating means, and causes a diaphragm forming a wall surface of the ink channel to slightly vibrate with the aid of the piezoelectric element in order to change the inner capacity of the ink channel to eject ink droplets. A thermal type recording head heats the ink in the ink channel by using a heat resistant element in order to generate air bubbles and cause pressure to occur to eject ink droplets. An electrostatic type recording head includes a diaphragm, which forms a wall surface of the ink channel and which is arranged so as to face an electrode, and deforms the diaphragm by an electrostatic force generated between the diaphragm and the electrode in order to change the inner volume of the ink channel to eject ink droplets.

In general, the recording head includes a plurality of nozzles for ejecting ink droplets, and includes an ink channel (pressure chamber) and a pressure generating means (hereinafter, an example will be described in which a piezoelectric element is used as the pressure generating means) for each of the nozzles. The nozzles are arrayed in a predetermined direction. Hereinafter, this direction is referred to as a nozzle array direction.

All of the piezoelectric elements are electrically connected in parallel between a common power supply line and a ground line, and switching elements are electrically connected in serial to the respective piezoelectric elements. Signals (drive waveforms) for driving the piezoelectric elements are generated by a drive waveform generating circuit, and selectively distributed and supplied to each of the piezoelectric elements via the power supply line and the switching element. Specifically, when a predetermined switching element is selected and turned on based on print data, a drive waveform is applied to the piezoelectric element via the power supply line, and ink droplets are ejected from a predetermined nozzle corresponding to the piezoelectric element to which the drive waveform is applied.

Further, there is a known recording head that ejects a plurality of types of ink droplets (for example, a large droplet, a medium droplet, and a small droplet) with different ink volumes in order to change the size of a dot formed on a recording medium to improve the gradation of an image. When this recording head is used, a drive waveform is set so as to sequentially eject ink droplets with changing the droplet velocity by a drive waveform of a plurality of pulse trains in a print cycle such that the droplets coalesce into a single droplet while the droplets are flying. As a system for driving the recording head as described above, a common drive circuit system is generally employed, which selectively applies a necessary waveform portion to each of the piezoelectric elements by a switching element by using a single common drive waveform that is a combination of a plurality of drive waveform components for ejecting a plurality of types of ink droplets.

Meanwhile, the drive waveform for driving the piezoelectric element normally needs to be a waveform with a relatively large voltage magnitude of 20 volts (V) to 40 V, and a drive waveform generating circuit for generating and driving the waveform is relatively large in size and power consumption. Therefore, it is often the case that the drive waveform generating circuit is not arranged inside the recording head that needs to be downsized, and a drive waveform generated by a different circuit board is supplied to the recording head through a power supply line. Further, the switching element provided for each of the piezoelectric elements is usually integrated with a control unit or the like that generates an ON/OFF selection signal, and arranged near the piezoelectric element inside the recording head. The integrated switching element is configured by a transistor, uses a high-voltage power MOSFET or the like to drive a relatively large voltage magnitude, and is large in size. Therefore, a ratio of the size of the switching element to the size of the integrated circuit is large.

To form a high-quality image in the image forming apparatus of the liquid ejection recording system, it is necessary to eject a desired amount of ink droplets onto a desired position on a recording medium. Therefore, the drive waveform supplied to the piezoelectric element is appropriately set by taking into account the ink droplet velocity, the stability of an ejection state (curved ejection, satellite, mist generation status), or the like.

However, there is more than a small amount of manufacturing variation in elements and members of each of the nozzles, such as variation in the shape of the nozzle of the recording head, the structure of the ink channel, the characteristics of the piezoelectric element, or the characteristics of the switching element. Therefore, in the conventional common drive circuit system, even when a drive waveform that is appropriately set by taking into account the ink droplet velocity or the stability of the ejection state is used, an ink droplet amount or a landing position may vary for each of the nozzles due to the above described variation, resulting in the reduced image quality.

As one solution for the above described issue, a technology as described in Japanese Patent No. 4764690 has been proposed. The technology described in Japanese Patent No. 4764690 is to select, for each of pressure generating elements, a drive waveform generating circuit for applying a drive signal waveform to each of the pressure generating elements from among a plurality of drive waveform generating circuits so as to cause liquid ejected from a plurality of nozzles to land in an approximately linear manner along the nozzle array direction.

However, the shape of the nozzle, the structure of the ink channel, the characteristics of the piezoelectric element, and the characteristics of the switching element independently vary. Therefore, to cope with all the variation by the technology described in Japanese Patent No. 4764690, a large number of drive waveform generating circuits are needed.

Further, even with a drive waveform that is appropriately set so as to sequentially eject ink droplets with changing the droplet velocity such that the droplets coalesce into a single droplet while the droplets are flying, it may be difficult to cause the flying droplets to coalesce into a single droplet because of a change in the droplet velocity due to the above described variation. In this case, it may be difficult to eject a desired amount of droplets onto a desired position, resulting in the reduced image quality. Specifically, the ejection characteristic varies for each of different types of ink droplets (a large droplet, a medium droplet, and a small droplet) with different ink volumes, so that if the variation is to be dealt with by the technology described in Japanese Patent No. 4764690, the number of combinations of appropriate drive waveforms becomes huge.

Therefore, in the technology described in Japanese Patent No. 4764690, to correct variation in the ink droplet amount and the landing position with high accuracy in order to prevent a reduction in the image quality, the size of the drive waveform generating circuit, the size of the switching element, and the size of the power supply line for supplying the drive waveform to the recording head increase. Consequently, the size of the apparatus, the power consumption, and the costs increase, which makes practical implementation difficult. In contrast, if the number of the drive waveform generating circuits is reduced within a realistic range, the correction accuracy for the variation in the ink droplet amount and the landing position is insufficient, which is inadequate to improve the image quality.

SUMMARY OF THE INVENTION

It is an object of the present invention to at least partially solve the problems in the conventional technology.

According to the present invention, there is provided a head driving device that drives a recording head including a plurality of nozzles and a plurality of pressure generating elements corresponding to the respective nozzles, the head driving device comprising: a plurality of drive waveform generating units corresponding to the respective pressure generating elements, wherein the drive waveform generating units drive the respective pressure generating elements on the basis of pieces of drive waveform information that are set for the respective nozzles so as to approximately equalize ejection characteristics of droplets ejected from the nozzles.

The present invention also provides a recording head unit comprising: the above-described head driving device; wherein the head driving device and the recording head are integrated with each other.

The present invention also provides an image forming apparatus comprising the above-described recording head unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
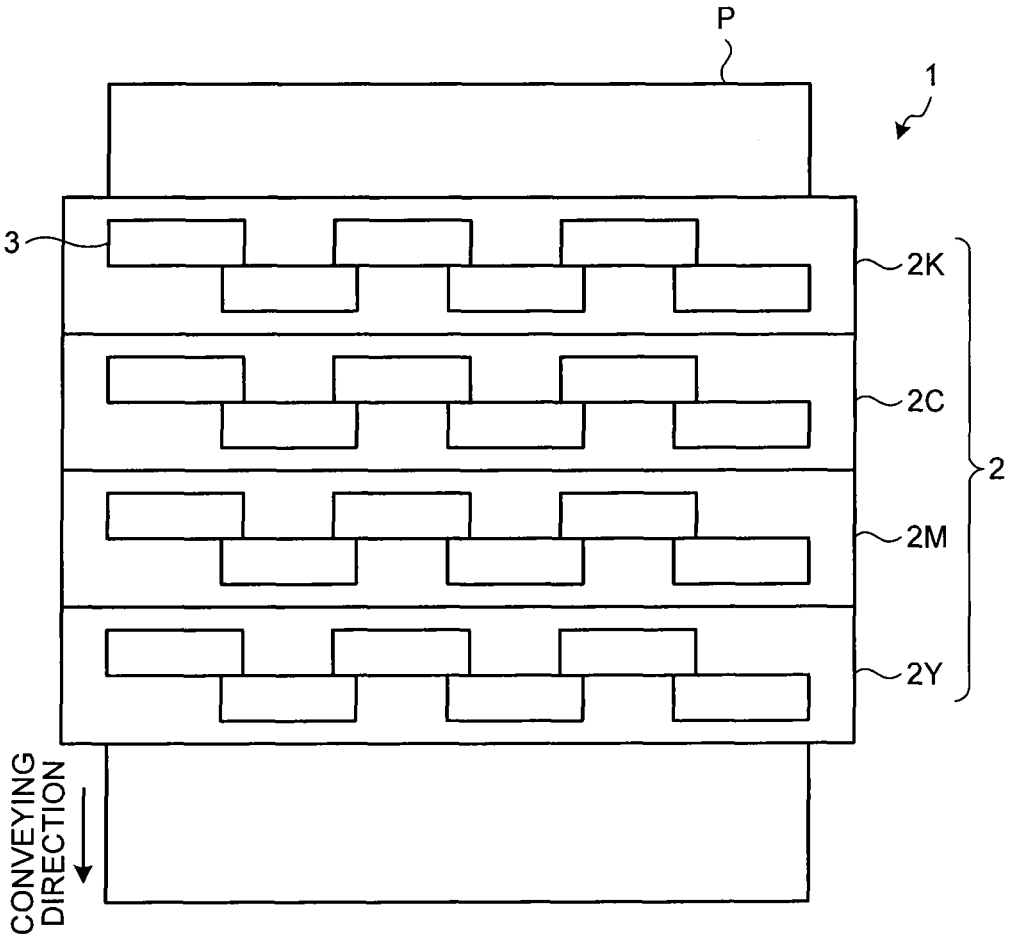
FIG. 1 is a diagram for explaining a schematic configuration of an image forming apparatus of an embodiment of the present invention.

Exemplary embodiments of the present invention will be described below. A head driving device of an embodiment drives a recording head including a plurality of nozzles and a plurality of pressure generating elements arranged so as to correspond to the respective nozzles, and includes a plurality of drive waveform generating units that individually drive the pressure generating elements for the respective nozzles. The drive waveform generating units drive the respective pressure generating elements on the basis of pieces of drive waveform information that are set for the respective nozzles so as to approximately equalize the ejection characteristics (at least one of an ink droplet amount and a landing position) of droplets (ink droplets) ejected from the nozzles.

With this configuration, the head driving device of the embodiment can cause the individual drive waveform generating unit to drive the pressure generating element for each of the nozzles so as to correct variation in the ink droplet amount or the landing position due to manufacturing variation in the nozzles of the recording head. Therefore, it is possible to reduce variation in the ink droplet amount or the landing position due to manufacturing variation in the nozzles with high accuracy, enabling to prevent a reduction in the image quality.

Each of the drive waveform generating units included in the head driving device of the embodiment includes, for example, a charge/discharge signal generating unit that generates a charge signal and a discharge signal, and a driver unit that charges and discharges the corresponding pressure generating element in accordance with the charge signal and the discharge signal. The charge signal is a signal for controlling a charge timing and a charge duration for the corresponding pressure generating element, and the discharge signal is a signal for controlling a discharge timing and a discharge duration for the corresponding pressure generating element. In this case, the drive waveform information set for each of the nozzles determines an ON/OFF timing of the charge signal and the discharge signal.

The driver unit includes, for example, a first switch for charging the pressure generating element in accordance with the charge signal, and a second switch for discharging the pressure generating element in accordance with the discharge signal. The charge/discharge signal generating unit determines the ON/OFF timing of the charge signal and the discharge signal on the basis of the drive waveform information such that a drive voltage applied to the pressure generating element corresponds to a drive waveform for correcting variation in the ink droplet amount or the landing position due to variation in the corresponding nozzle, and controls charge and discharge of the pressure generating element performed by the driver unit.

Meanwhile, the charge/discharge signal generating unit can be configured by a transistor of a low-voltage process, and therefore, only the driver unit uses a high-voltage process with a large transistor size. Therefore, even if a plurality of the drive waveform generating units are provided for the respective nozzles, it is possible to implement an integrated circuit with a chip size satisfactory for installation on the recording head. Consequently, it is possible to prevent an increase in the size of an apparatus, an increase in the power consumption, an increase in costs, or the like that may occur when the drive waveform generating units are provided on a different circuit board from the recording head.

A recording head unit of the embodiment is configured by integrating the head driving device of the embodiment with a recording head. Further, an image forming apparatus of the embodiment includes the recording head unit of the embodiment. In the following, details of the head driving device, the recording head unit, and the image forming apparatus of the embodiment will be described with reference to the accompanying drawings.

FIG. 1 is a diagram for explaining a schematic configuration of the image forming apparatus of the embodiment. An image forming apparatus 1 illustrated in FIG. 1 is configured as a line-scanning-type inkjet recording device, and includes a recording unit 2 that forms an image on a recording medium P. Meanwhile, FIG. 1 is a view looking straight down at a recording surface of the recording medium P.

The recording medium P is, for example, a sheet of paper, and may be a roll sheet (continuous sheet) or a cut sheet. Further, various media other than the sheet of paper may be used as the recording medium P. The recording medium P is conveyed by a medium conveying means (not illustrated) in a predetermined conveying direction indicated by an arrow in FIG. 1.

The recording unit 2 is supported by a supporting means (not illustrated) so as to face the recording surface of the recording medium P while maintaining a predetermined distance from the recording surface. The recording unit 2 includes a plurality of recording units 2K, 2C, 2M, and 2Y corresponding to black (K) ink, cyan (C) ink, magenta (M) ink, and yellow (Y) ink, respectively. The image forming apparatus 1 causes the recording unit 2 to eject ink droplets for each print cycle corresponding to a conveying speed of the recording medium P, to thereby form a color image on the recording medium P. As a matter of course, the image forming apparatus 1 includes a mechanism or the like for controlling conveyance of the recording medium P such that the recording medium P passes through a predetermined position relative to the recording unit 2 at a predetermined speed; however, the drawings and detailed explanation of components including the above described conveyance control mechanism that are not directly related to the gist of the embodiment will be omitted.

Each of the recording units 2K, 2C, 2M, and 2Y includes a plurality of recording heads 3 that are arrayed in a direction perpendicular to the conveying direction of the recording medium P. The recording heads 3 may be arranged in a single line in the direction perpendicular to the conveying direction of the recording medium P, or may be arranged in zigzag as illustrated in FIG. 1. In the image forming apparatus 1, the recording units 2K, 2C, 2M, and 2Y are configured such that the recording heads 3 are arrayed as described above in order to ensure a wide printing area.

Figure 2:
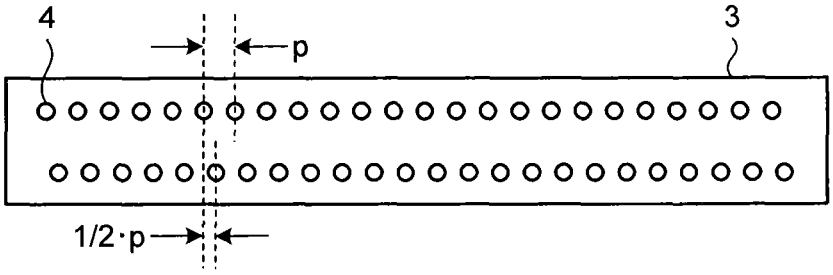
FIG. 2 is a diagram illustrating an example of a recording head.

FIG. 2 is a diagram illustrating an example of the recording head 3, and is a plan view of the recording head 3 when viewed from an ink ejection surface side. The recording head 3 includes a plurality of nozzles 4 arranged at a predetermined pitch p in the direction perpendicular to the conveying direction of the recording medium P (that is, in the nozzle array direction). In the recording head 3 illustrated in FIG. 2, two nozzle arrays are arranged. One of the nozzle arrays is formed such that each of the nozzles 4 is shifted by about ½/p in the nozzle array direction relative to the other one of the nozzle arrays, so that it is possible to form an image at high resolution in the nozzle array direction.

Figure 3A:
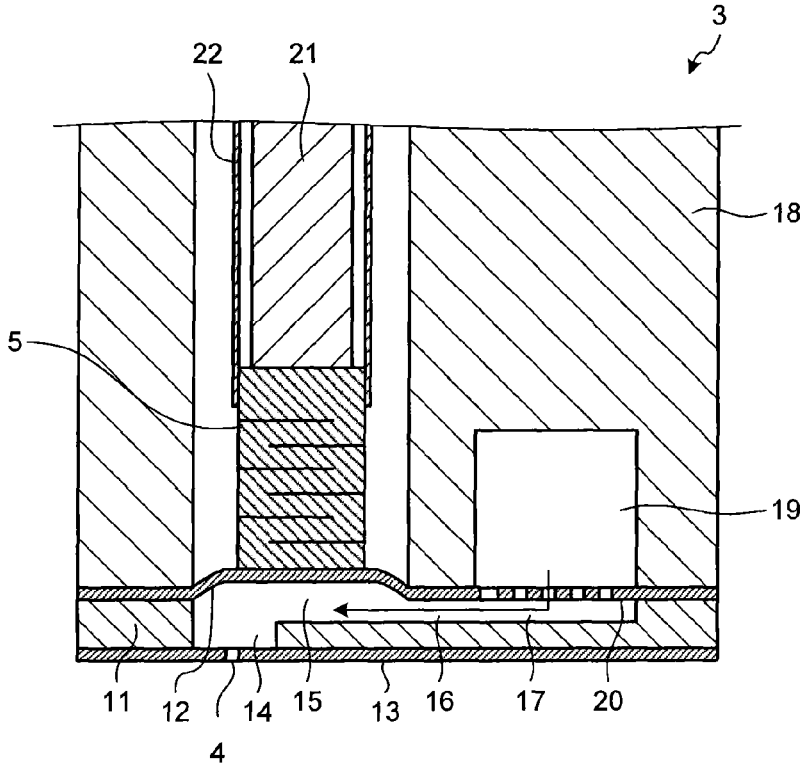
FIGS. 3A and 3B are diagrams for explaining an internal configuration of the recording head.
Figure 3B:
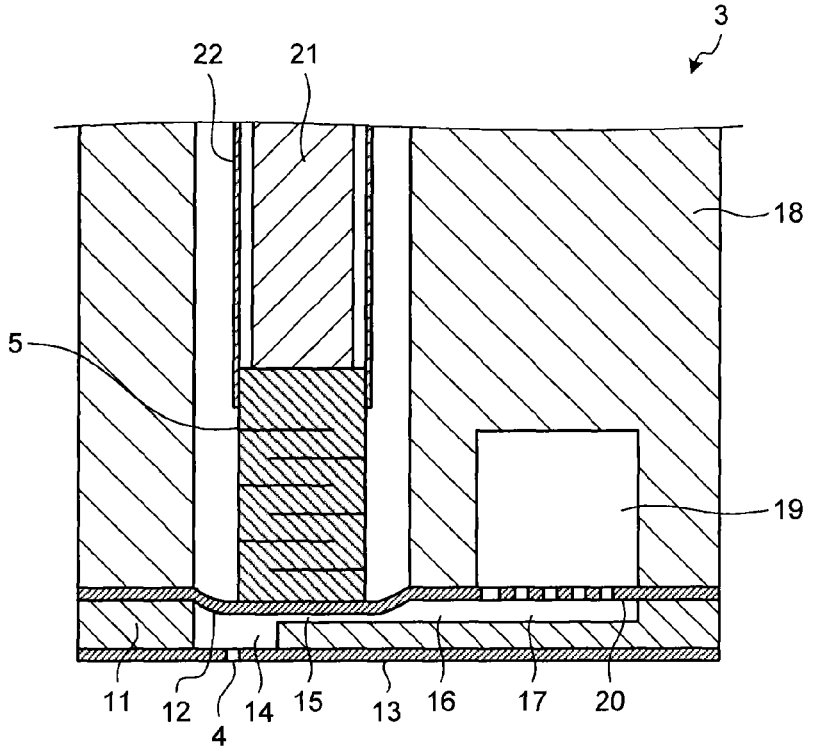

FIGS. 3A and 3B are diagrams for explaining an internal configuration of the recording head 3, and are cross-sectional views of the recording head 3 along a longitudinal direction of a liquid chamber (a direction perpendicular to the nozzle array direction). The recording head 3 includes, in a portion formed by joining a channel plate 11, a diaphragm 12, and a nozzle plate 13 together, the nozzle 4 for ejecting a droplet, an individual liquid chamber 15 (may be referred to as a pressurized chamber, a pressurized liquid chamber, a pressure chamber, an individual channel, or a pressure generation chamber; hereinafter, simply referred to as "a liquid chamber") communicating with the nozzle 4 via a through hole 14, a fluid resistance portion 16 for supplying liquid to the liquid chamber 15, and a liquid introducing portion 17. A common liquid chamber 19 is formed in a frame member 18, and a filter portion 20 is formed in a portion connected to the common liquid chamber 19 on the diaphragm 12. Liquid (ink) filled in the common liquid chamber 19 is introduced to the liquid introducing portion 17 through the filter portion 20, and is supplied to the liquid chamber 15 from the liquid introducing portion 17 through the fluid resistance portion 16.

The channel plate 11 is formed by laminating metal plates, such as stainless steel (SUS), and defining openings or grooves serving as the through hole 14, the liquid chamber 15, the fluid resistance portion 16, and the liquid introducing portion 17. The channel plate 11 is not limited to a metal plate, such as SUS, but may be formed by anisotropic etching of a silicon substrate.

The diaphragm 12 is a wall member that forms wall surfaces of the liquid chamber 15, the fluid resistance portion 16, the liquid introducing portion 17, and the like, and also forms the filter portion 20.

A laminated piezoelectric element 5 (an example of a pressure generating means), which generates energy for pressurizing the ink in the liquid chamber 15 and ejecting ink droplets from the nozzle 4, is joined to a surface of the diaphragm 12 opposite to the liquid chamber 15. An end of the piezoelectric element 5 opposite to the end joined to the diaphragm 12 is joined to a base member 21. A flexible printed circuit (FPC) board 22 that transmits a drive waveform to the piezoelectric element 5 is connected to the piezoelectric element 5.

The piezoelectric element 5 is provided so as to be individually driven for each of the liquid chambers 15, that is, for each of the nozzles 4.

In the recording head 3 configured as described above, as illustrated in FIG. 3A, if a voltage applied to the piezoelectric element 5 is reduced from a reference potential Ve, the piezoelectric element 5 contracts and the diaphragm 12 is deformed, so that the capacity of the liquid chamber 15 increases and ink flows into the liquid chamber 15. Subsequently, as illustrated in FIG. 3B, if the voltage applied to the piezoelectric element 5 is increased to expand the piezoelectric element 5 in the lamination direction, the diaphragm 12 is deformed toward the nozzle 4 side and the capacity of the liquid chamber 15 decreases. Therefore, the ink in the liquid chamber 15 is pressurized and ink droplets are ejected from the nozzle 4.

Thereafter, if the voltage applied to the piezoelectric element 5 is returned to the reference potential Ve, the diaphragm 12 is restored to the initial position, so that the liquid chamber 15 expands and negative pressure occurs. At this time, the liquid chamber 15 is replenished with ink from the common liquid chamber 19. After the vibration of the meniscus surface at the nozzle 4 attenuates to be stable, the operation moves on to next ink droplet ejection. In this example, the piezoelectric element 5 is used in a d33 mode in which the piezoelectric element 5 expands and contracts in the lamination direction; however, it may be possible to use the piezoelectric element 5 in a d31 mode in which the piezoelectric element 5 expands and contracts in a direction perpendicular to the lamination direction.

Incidentally, an ink droplet ejected from the nozzle 4 lands on the recording medium P, which is located at a constant distance L from the nozzle 4, after a flying time Tj. In this case, assuming that an ejection speed of the ink droplet is denoted by Vj, Tj=L/Vj. The ejection speed Vj varies due to variation in shapes of members or variation in device characteristics among the nozzles 4. Therefore, the flying time Tj of the ink droplet ejected from each of the nozzles 4 varies due to variation in the ejection speed Vj among the nozzles 4, but the recording medium P is conveyed at a constant speed; therefore, landing positions in the conveying direction vary. Further, the ejection amounts of ink droplets also vary.

Figure 4:
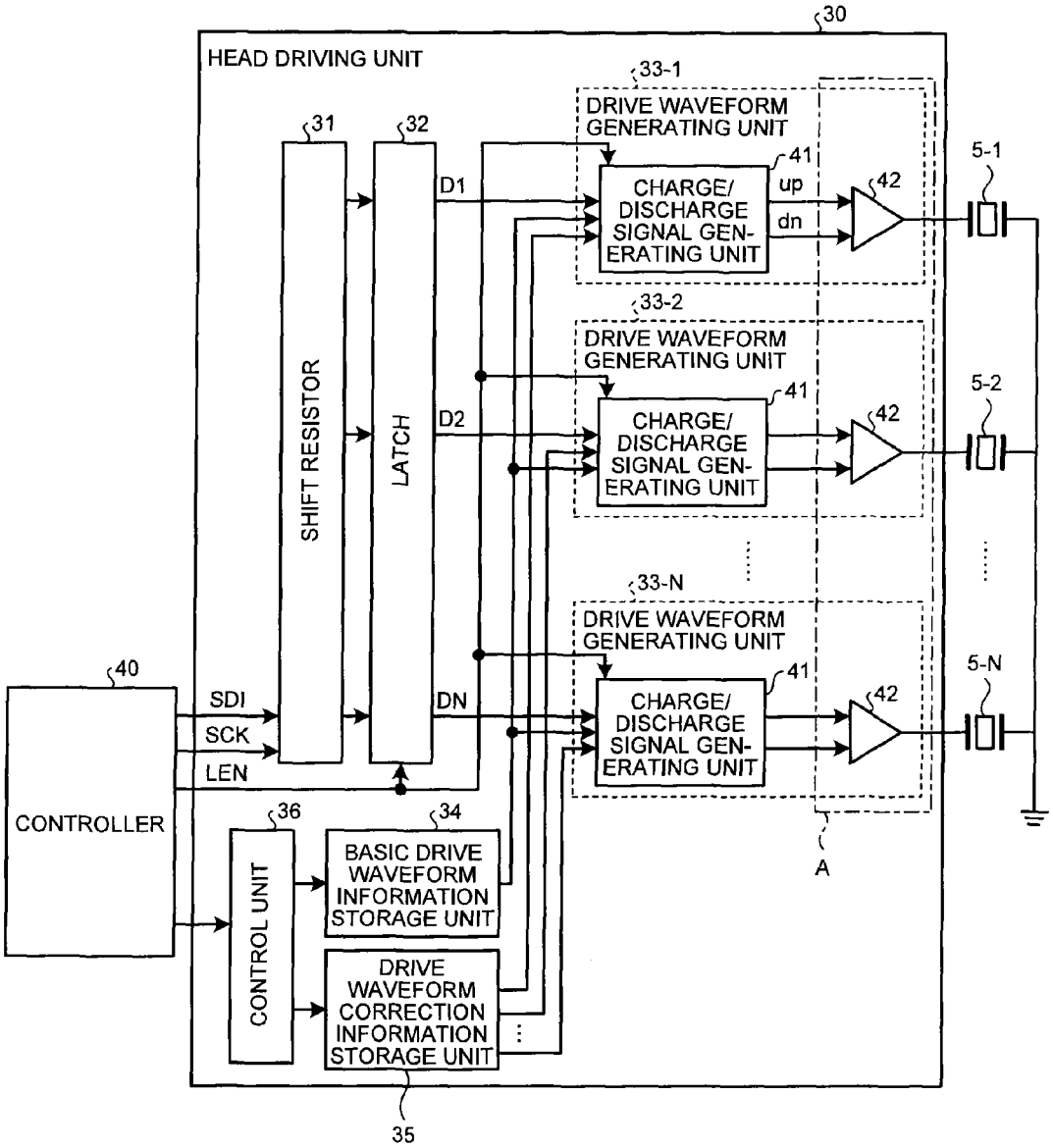
FIG. 4 is a block diagram illustrating a configuration example of a head driving unit.

Next, a configuration of a head driving unit (an example of the head driving device) that drives the recording head 3 will be described with reference to FIG. 4. FIG. 4 is a block diagram illustrating a configuration example of the head driving unit. A head driving unit 30 illustrated in FIG. 4 is configured to drive the N piezoelectric elements 5 (5-1 to 5-N) corresponding to the N nozzles 4 provided on the recording head 3. The head driving unit 30 illustrated in FIG. 4 drives the piezoelectric elements 5 of one nozzle array on the recording head 3. For example, in the image forming apparatus 1 configured as illustrated in FIG. 1, the head driving unit 30 is provided for each of the nozzle arrays in each of the recording heads 3 provided on each of the recording units 2K, 2C, 2M, and 2Y.

One electrode of each of the piezoelectric elements 5 provided for each of the nozzles 4 of the recording head 3 is connected to a common potential (for example, a ground), together with the other piezoelectric elements 5, via the FPC board 22 that transmits a drive waveform, and the other electrode is connected to the head driving unit 30.

The head driving unit 30 includes a single or a plurality of integrated circuits, and at least a portion connected to the piezoelectric element 5 is mounted on the FPC board 22. The head driving unit 30 individually generates an optimal drive waveform for the piezoelectric element 5 corresponding to each of the nozzles 4 so as to eject ink droplets in an appropriate condition from each of the nozzles 4 on the basis of data transferred from a controller 40, and drives each of the piezoelectric elements 5.

Incidentally, the head driving unit 30 may be integrated with the recording head 3. The recording head unit of the embodiment is configured by integrating the head driving unit 30 with the recording head 3.

The controller 40 divides printing image data into pieces of image data corresponding to the respective recording heads 3 and the respective nozzle arrays, and transfers the pieces of the image data to the head driving unit 30. Further, the controller 40 has a function to transfer and set, to the head driving unit 30, basic drive waveform information and drive waveform correction information that are used by the head driving unit 30 for generating a drive waveform, or a function to supply various control signals to the head driving unit 30.

The head driving unit 30 includes, as illustrated in FIG. 4, a shift register 31, a latch 32, drive waveform generating units 33 (33-1 to 33-N), a basic drive waveform information storage unit 34, a drive waveform correction information storage unit 35, and a control unit 36.

The controller 40 serially inputs N pieces of image data SDI corresponding to data of one line of the recording head 3 to the head driving unit 30, in synchronization with a transfer clock SCK. The serially input N pieces of image data are sequentially stored in the shift register 31. Herein, assuming that the recording head 3 ejects, from the nozzles 4, ink droplets corresponding to dots of different sizes indicated by four values of a large droplet, a medium droplet, a small droplet, and no ejection for example, a single piece of image data is 2-bit data.

The latch 32 includes N latches for storing, in response to input of a latch enable signal LEN, the N pieces of image data temporarily stored in the shift register 31, and each of the latches stores therein 2-bit data (D1 to DN) and supplies the data to the corresponding drive waveform generating unit 33.

The drive waveform generating units 33 generate drive waveforms for individually driving the N piezoelectric elements 5-1 to 5-N, and serve as the N drive waveform generating units 33-1 to 33-N corresponding to the respective piezoelectric elements 5-1 to 5-N. A drive waveform generating unit 33-*i* that is the i-th (i is 1 to N) channel, upon receiving a piece of 2-bit image data Di supplied from the latch 32 in synchronization with the latch enable signal LEN, refers to the basic drive waveform information stored in the basic drive waveform information storage unit 34 and the correction information stored in the drive waveform correction information storage unit 35, generates a drive waveform by using the latch enable signal LEN as a reference for start, and supplies the drive waveform to a piezoelectric element 5-*i*.

The basic drive waveform information storage unit 34 stores therein pieces of the basic drive waveform information, each of which is information on a basic drive waveform that does not contain correction information for each of the nozzles 4 (for each of the channels), as drive waveforms for the respective dots of different sizes such as a large droplet, a medium droplet, a small droplet, and no ejection. The drive waveform generating unit 33-*i* acquires a piece of the basic drive waveform information corresponding to the piece of the image data Di supplied from the latch 32 from among the pieces of the basic drive waveform information stored in the basic drive waveform information storage unit 34 (for example, if the piece of the image data Di is data indicating a large droplet, the drive waveform generating unit 33-*i* acquires a piece of the basic drive waveform information for the large droplet). Details of the basic drive waveform information will be described later.

Further, the drive waveform correction information storage unit 35 stores therein pieces of the correction information for correcting the pieces of the basic drive waveform information for the respective nozzles 4 (for the respective channels). The drive waveform generating unit 33-*i* acquires a piece of the correction information corresponding to the i-th channel from among the pieces of the correction information stored in the drive waveform correction information storage unit 35. Then, the drive waveform generating unit 33-*i* corrects the piece of the basic drive waveform information acquired from the basic drive waveform information storage unit 34 by using the piece of the correction information acquired from the drive waveform correction information storage unit 35 to generate a drive waveform optimal to drive the i-th channel, and supplies the drive waveform to the piezoelectric element 5-*i*.

The control unit 36 controls the entire head driving unit 30. The control unit 36 has a function to communicate with the controller 40, and performs a process of receiving the basic drive waveform information or the correction information as described above from the controller 40 and setting the basic drive waveform information or the correction information in the basic drive waveform information storage unit 34 or the drive waveform correction information storage unit 35 or updating the information, for example.

Next, a detailed configuration of the drive waveform generating unit 33 will be described. Each of the drive waveform generating units 33 (33-1 to 33) includes, as illustrated in FIG. 4, a charge/discharge signal generating unit 41 and a driver unit 42.

The charge/discharge signal generating unit 41 generates a charge signal up for controlling a charge timing and a charge duration of the piezoelectric element 5 and a discharge signal dn for controlling a discharge timing and a discharge duration of the piezoelectric element 5, from the image data Di, the basic drive waveform information, the correction information, and the latch enable signal LEN serving as a reference for starting waveform generation.

The driver unit 42 charges the piezoelectric element 5 in accordance with the charge signal up generated by the charge/discharge signal generating unit 41, and discharges the piezoelectric element 5 in accordance with the discharge signal dn generated by the charge/discharge signal generating unit 41.

Figure 5:
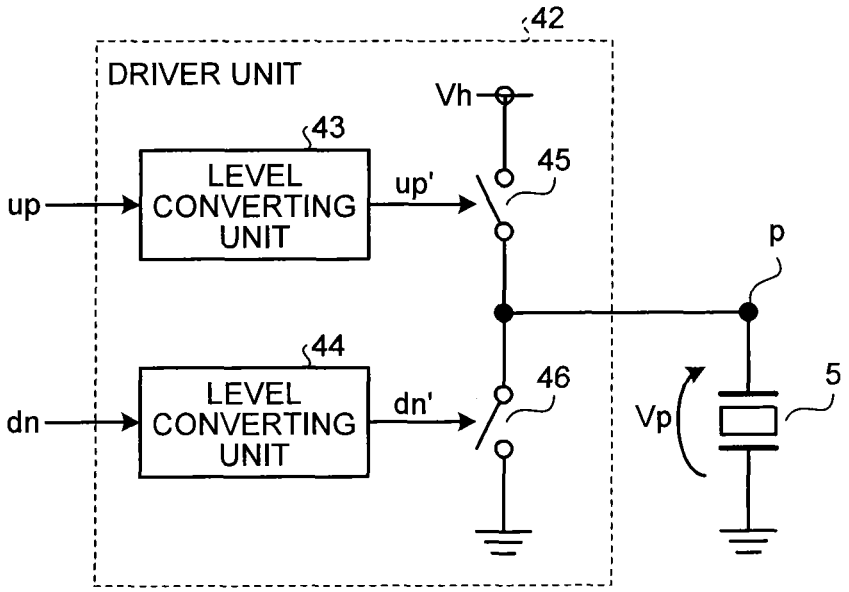
FIG. 5 is a diagram illustrating a configuration example of a driver unit.

FIG. 5 is a diagram illustrating a configuration example of the driver unit 42. As illustrated in FIG. 5, the driver unit 42 includes level converting units 43 and 44, a first switch 45, and a second switch 46.

The first switch 45 is connected to a power supply with a voltage value Vh and a point p on one end side of the piezoelectric element 5. The second switch 46 is connected to the point p on one end side of the piezoelectric element 5 and the ground. In a period in which the charge signal up is active, the first switch 45 is ON and the piezoelectric element 5 is charged to the voltage value Vh of the power supply. In contrast, in a period in which the discharge signal dn is active, the second switch 46 is ON and the piezoelectric element 5 is discharged to the ground. Further, the level converting units 43 and 44 convert the voltages of the charge signal up and the discharge signal dn to voltage levels at which the first switch 45 and the second switch 46 are turned on and off. The first switch 45 is configured by a p-MOS transistor, for example. The second switch 46 is configured by an n-MOS transistor, for example. Meanwhile, the voltage value Vh of the power supply is for supplying a voltage equal to or greater than the maximum voltage to be applied to the piezoelectric element 5, and is normally set to about 20 V to 40 V.

By configuring the driver unit 42 as described above, a timing and a period for activating the charge signal up and the discharge signal dn are controlled, so that it is possible to control a voltage Vp (that is, a drive waveform) to be applied to the piezoelectric element 5 in an arbitrary waveform. Meanwhile, each of the drive waveform generating units 33 (33-1 to 33-N) is individually provided for each of the N piezoelectric elements 5-1 to 5-N; therefore, it is possible to drive each of the piezoelectric elements with the optimal drive waveform. Namely, even if the ink droplet amount or the landing position varies due to variation in the shape of each of the nozzles 4, the structure of the ink channel, the characteristics of the piezoelectric element, the characteristics of the switching element, or the like, it is possible to correct each of the drive waveforms so as to reduce the variation, enabling to prevent a reduction in the image quality.

Further, in the head driving unit 30, only the driver unit 42 (in a section A enclosed by a chain line in FIG. 4) is a circuit that needs to be configured by a high-voltage process and that operates by being connected to the power supply (the voltage value Vh), and others can be configured by a low-voltage process, such as a core voltage of 1 V. Furthermore, a conventional drive waveform generating circuit needs a digital-to-analog (DA) converter, a voltage amplifier, or a current amplifier in order to generate a drive waveform and perform driving, and the sizes of the components remain large even when integration is implemented. In contrast, in the embodiment, it is possible to drive the piezoelectric element 5 by a simple configuration as illustrated in FIG. 5. Therefore, even if a plurality of the drive waveform generating units 33 are provided for the respective nozzles 4, it is possible to implement an integrated circuit with a chip size satisfactory for installation on the recording head 3. Even in the conventional recording head, at least a pair of bi-directional switching elements are provided for each of the piezoelectric elements, and the switching elements are normally configured by at least two transistors because electrical currents bi-directionally flow into the bi-directional switching elements. Namely, even in the configuration in which a plurality of the drive waveform generating units 33 are provided so as to correspond to the respective piezoelectric elements 5 as in the embodiment, a chip size is not increased as compared to the conventional recording head. Therefore, it is possible to prevent an increase in the size of an apparatus, an increase in the power consumption, an increase in costs, or the like.

Figure 6:
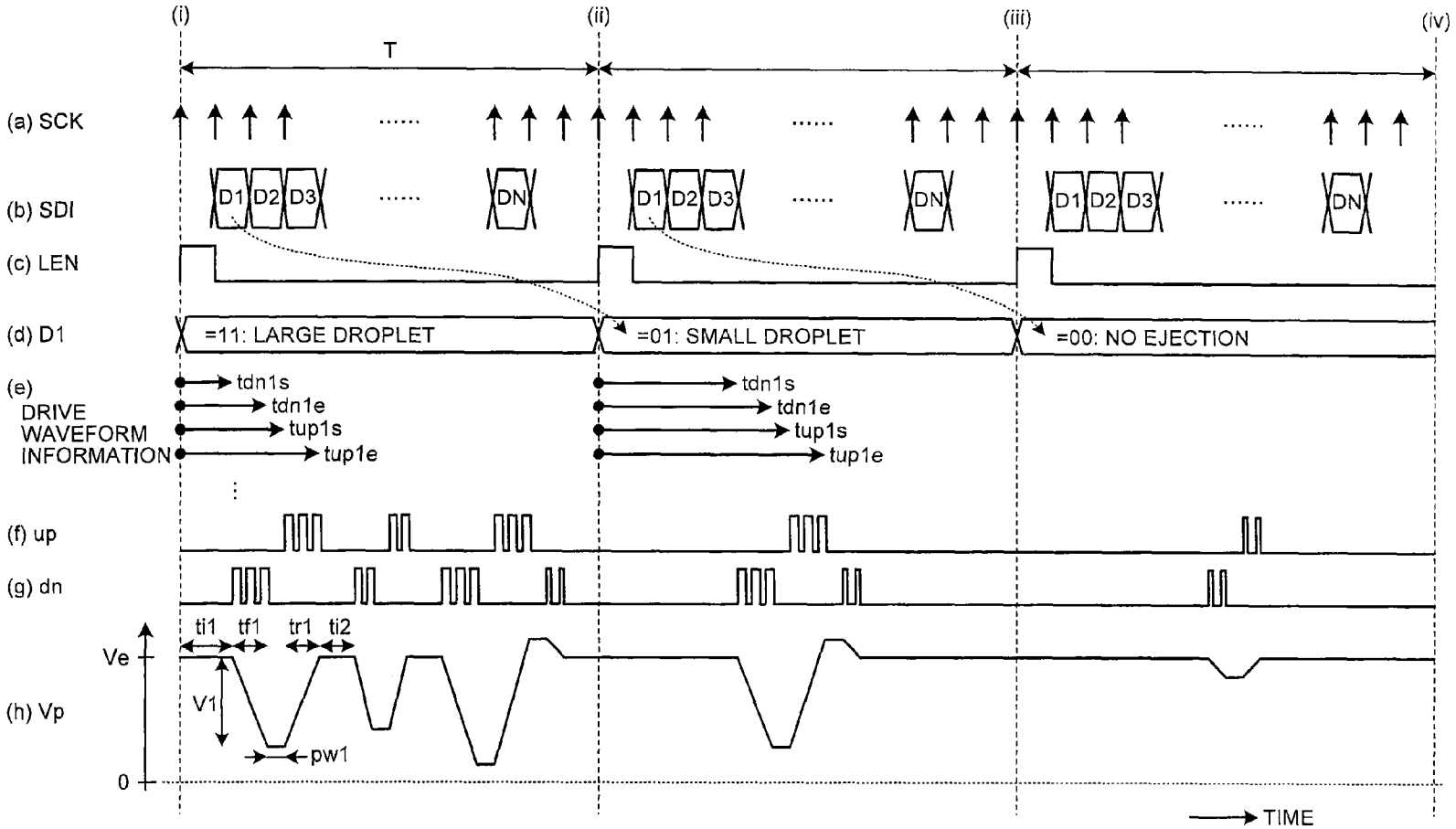
FIG. 6 is a timing diagram of main signals for explaining operation of the head driving unit.

FIG. 6 is a timing diagram of main signals for explaining operation of the head driving unit 30 of the embodiment. The recording head 3 of the embodiment performs ejection in a predetermined print cycle T. The print cycle T is determined by the conveying speed of the recording medium P and a print resolution of each of the nozzle arrays in the conveying direction.

In FIG. 6, (a) indicates the transfer clock SCK, and (b) indicates pieces of the image data SDI. The controller 40 inputs the pieces of the image data SDI indicated by (b) to the head driving unit 30 in synchronization with the transfer clock SCK indicated by (a). A cycle of the transfer clock SCK is determined such that N pieces of image data corresponding to the N nozzles 4 driven by the head driving unit 30 are transferred in one print cycle T. In the example illustrated in FIG. 6, the pieces of the image data SDI are sequentially transferred in order from the piece of image data D1; however, the piece of the image data may be transferred in reverse order.

In FIG. 6, (c) indicates the latch enable signal LEN, and (d) indicates a piece of image data among the pieces of the latched image data SDI. In the head driving unit 30, the pieces of the image data SDI that are serially transferred in the previous cycle are latched at a rise timing of the latch enable signal LEN indicated by (c). Only a single piece of image data among the piece of the latched image data SDI is indicated by (d); however, pieces of image data D2 to DN are also latched at the same timing. At a time (i), a piece of data (in this example, with a value of 11 indicating ejection of a large droplet) transferred in the previous cycle is latched. At a time (ii), a piece of data (in this example, with a value of 01 indicating ejection of a small droplet) transferred in a cycle from the time (i) to the time (ii) is latched. Further, in the embodiment, the latch enable signal LEN serves as a reference for starting drive waveform generation as will be described later; therefore, a cycle of the latch enable signal LEN is the print cycle T. Incidentally, the latch enable signal LEN and a signal indicating a reference for starting drive waveform generation may be input as individual signals, or a signal delayed from the latch enable signal LEN by a predetermined amount may be used as a signal indicating a reference for starting drive waveform generation.

In FIG. 6, (e) to (h) indicate specific examples of the operation of the drive waveform generating unit 33. In the following, the drive waveform generating unit 33-1 that drives the piezoelectric element 5-1 as the first channel will be described by way of example; however, the same applies to the other channels 2 to N. (e) indicates a part of the drive waveform information indicating information on a drive waveform generated by the drive waveform generating unit 33-1. (f) indicates the charge signal up generated based on the drive waveform information indicated by (e). (g) indicates the discharge signal do generated based on the drive waveform information indicated by (e). (h) indicates the drive voltage Vp applied to the piezoelectric element 5-1. The drive voltage Vp is normally maintained at the reference potential Ve, and the potential of the drive voltage Vp gradually decreases when the piezoelectric element 5-1 is discharged in accordance with the discharge signal dn indicated by (g). In contrast, when the piezoelectric element 5-1 is charged in accordance with the charge signal up indicated by (f), the potential of the drive voltage Vp gradually increases. Further, when both of the charge signal up and the discharge signal dn are inactive, the previous potential is maintained. In a precise sense, self-discharge of an insulation resistance component or the like of the piezoelectric element 5-1 occurs; however, the self-discharge in the print cycle T is negligible. The charge signal up and the discharge signal dn are controlled so as not to be activated simultaneously.

Next, an example of a drive waveform to be generated will be described. In the cycle from the time (i) to the time (ii) in FIG. 6, the drive waveform generating unit 33-1 generates a drive waveform for ejecting a large droplet. When a large droplet is to be ejected, the piezoelectric element 5 is driven with a drive waveform with three consecutive pulses as illustrated in FIG. 6, and each of a pulse interval ti*, a pulse width pw*, a pulse wave peak value V*, a fall time tf*, and a rise time tr* (* is a numeral indicating the order) needs to controlled so as to be a desired value such that droplets ejected at the respective pulses coalesce together while flying and a desired amount of droplets are ejected to a desired landing position. To accurately control the parameters after correcting variations for each of the nozzles 4, it is preferable to accurately control (in chronological order) a charge/discharge timing and a charge/discharge period for the piezoelectric element 5, that is, the charge signal up and the discharge signal dn for controlling the charge/discharge timing and the charge/discharge period. To accurately generate the charge signal up and the discharge signal dn, a clock CLK for generating a drive waveform is supplied to the head driving unit 30 from the outside, or the clock CLK is generated in the head driving unit 30 by using a phase-locked loop (PLL) circuit or the like (not illustrated).

The charge signal up and the discharge signal dn are generated based on the drive waveform information. In the embodiment, the drive waveform information is determined based on the basic drive waveform information and the correction information as described above. The basic drive waveform information is used for determining a representative value of the ejection characteristics of ink droplets ejected from the nozzles 4, and is defined by a representative value (nominal value) of the nozzles 4. In contrast, the correction information is information determined for each of the nozzles 4 in advance so as to correct variation for each of the nozzles 4 such that the ejection characteristics are approximately equalized to the representative value.

Pieces of the basic drive waveform information are stored in the basic drive waveform information storage unit 34 in accordance with different droplet sizes (for example, a large droplet, a medium droplet, a small droplet, and no ejection). The drive waveform generating unit 33 refers to (acquires) a piece of the basic drive waveform information corresponding to the droplet size of a droplet ejected from the corresponding nozzle 4 from among the pieces of the basic drive waveform information stored in the basic drive waveform information storage unit 34. In the cycle from the time (i) to the time (ii) in FIG. 6, the drive waveform generating unit 33-1 refers to (acquires) a piece of the basic drive waveform information for a large droplet on the basis of a value (=11) of a piece of the latched image data D1.

Meanwhile, the ejection characteristics change depending on an ink temperature; therefore, the basic drive waveform information is prepared for each ink temperature, and information stored in the basic drive waveform information storage unit 34 is updated in accordance with the ink temperature. Alternatively, it may be possible to store pieces of the basic drive waveform information corresponding to all temperature ranges in the basic drive waveform information storage unit 34 in advance, cause the controller 40 to send information indicating a current ink temperature to each of the drive waveform generating units 33 via the control unit 36, and cause the drive waveform generating units 33 to change the basic drive waveform information to be referred to in accordance with the current ink temperature.

Each piece of the correction information is a correction value of a drive waveform for ejecting ink from each of the nozzles 4, and pieces of the correction information corresponding to the respective nozzles 4 (respective channels) are stored in the drive waveform correction information storage unit 35. The drive waveform generating unit 33 refers to (acquires) a piece of the correction information corresponding to own channel from among the pieces of the correction information stored in the drive waveform correction information storage unit 35. By adding the piece of the correction information to the above described piece of the basic drive waveform information, the drive waveform information in this cycle is obtained. It may be possible to store a part or the whole of each piece of the correction information for each of the nozzles 4 in accordance with each size of a droplet (for example, a large droplet, a medium droplet, a small droplet, or no ejection), similarly to the basic drive waveform information. In this case, the drive waveform generating unit 33 adds a piece of the correction information corresponding to the droplet size of a droplet ejected from the nozzle 4 among the pieces of the correction information corresponding to own channel to the above described piece of the basic drive waveform information corresponding to the droplet size in order to obtain the drive waveform information.

The charge signal up and the discharge signal dn are counted from a reference for starting drive waveform generation (in this example, rise of LEN), with reference to the clock CLK, on the basis of the drive waveform information, and ON/OFF times are controlled. In the drive waveform information, tdn1*s* indicates a first discharge start time, and tdn1*e* indicates a first discharge end time. Further, by repeating ON/OFF of discharge during the discharge period, it is possible to perform discharge in a multistage manner. The charge/discharge signal generating unit 41 generates the discharge signal dn in accordance with the discharge start time tdn1*s*, the discharge end time tdn1*e*, and a duty (ON period) during the discharge period and controls discharge of the piezoelectric element 5, so that it is possible to control the pulse wave peak value V1 and a fall time tf1.

Figure 7:
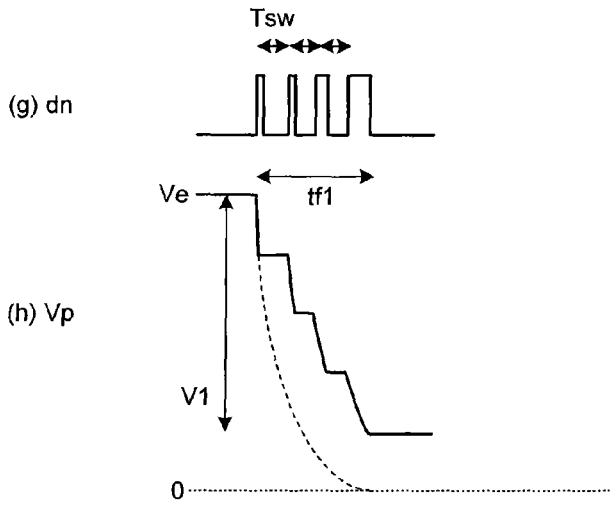
FIG. 7 is a diagram for explaining operation in a discharge period.

FIG. 7 is a diagram for explaining operation in the discharge period, in which (g) indicates the discharge signal dn and (h) indicates the drive voltage Vp applied to the piezoelectric element 5 when the second switch 46 is operated in accordance with the discharge signal dn indicated by (g). For example, when the potential of the drive voltage Vp illustrated in FIG. 5 is Ve, and if the second switch 46 is turned on to perform discharge, the discharge is performed at a time constant $\tau$ (=R/C) (a dashed line in FIG. 7) that is determined by a resistance component R, such as an ON resistance of the second switch 46, and a capacity C of the piezoelectric element 5. In this case, the discharge is performed in a shorter time than a desired fall time tf1; therefore, the second switch 46 is repeatedly turned ON (to perform discharge) and OFF (to maintain the potential) in a cycle Tsw as in the discharge signal dn indicated by (g) in FIG. 7 to perform the discharge in a stepwise manner, so that the discharge is performed in the desired fall time tf1. Further, by changing an ON period (duty) in the cycle Tsw, it is possible to control the fall time tf1 and the pulse wave peak value V1.

Incidentally, as illustrated in FIG. 7, it may be possible to change the duty or the cycle Tsw of repetition during the discharge period (tf1). Further, by shorting the cycle of repetition, the potential changes more smoothly rather than in a stepwise manner. Incidentally, the time constant $\tau$ is dominated by the manufacturing variation in the device; therefore, it is preferable to measure the time constant $\tau$ by each channel in advance at the time of manufacture (for example, a discharge time in which Ve is reduced by a predetermined potential is measured), convert the time constant into the above described correction information, and store the correction information.

Referring back to FIG. 6, in the drive waveform information, tup1*s* indicates a first charge start time, and tuple indicates a first charge end time. The charge/discharge signal generating unit 41 generates the charge signal up in accordance with the charge start time tup1*s*, the charge end time tuple, and a duty (ON period) during the charge period and controls charge of the piezoelectric element 5, so that it is possible to control the pulse width pw1, the rise time tr1, and a pulse wave peak value (in this example, the peak value is the same as V1 and returned to the potential Ve).

As for the subsequent pulses, similarly to the above, it is possible to control the pulse interval ti*, the pulse width pw*, the pulse wave peak value V*, the fall time tf*, and the rise time tr*, so that even when there is variation for each of the nozzles 4, it is possible to generate a drive waveform for ejecting a desired amount of ink to a desired landing position.

In a cycle from the time (ii) to a time (iii), the drive waveform generating unit 33-1 generates a drive waveform for ejecting a small droplet. The drive waveform for a small droplet has a single pulse as illustrated in FIG. 6, for example. In this cycle, the drive waveform generating unit 33-1 refers to (acquires) a piece of the basic drive waveform information for a small droplet on the basis of a value (=01) of a piece of the latched image data D1. Then, by adding a piece of the correction information corresponding to the channel to the piece of the basic drive waveform information, the drive waveform information in this cycle is obtained. Thereafter, a drive waveform is generated in the same manner as in the above described example.

In a cycle from the time (iii) to a time (iv), a piece of the latched image data D1 indicates no ejection (=00), and, at normal times, vibration that does not cause the nozzle 4 to eject droplets is applied in order to prevent ink drying, clogging by liquid, or the like (this operation is referred to as minute drive). In this case, a piece of basic drive waveform information for the minute drive (no ejection) is referred to and a drive waveform is generated in the same manner.

Incidentally, the basic drive waveform information is stored, as information indicating a drive waveform designed to fit the characteristics of ink to be used, in an information storage means (for example, a program storage ROM or a nonvolatile memory of the controller 40) in the image forming apparatus 1, when the recording head 3 or the image forming apparatus 1 is designed, for example. When the image forming apparatus 1 is activated, the controller 40 reads the basic drive waveform information and sets the basic drive waveform information in the basic drive waveform information storage unit 34, for example.

Further, the correction information is obtained by measuring the ejection state of the nozzle 4 or variation in the landing position or the amount of droplets from a print image of a test pattern, converting the measured value into the correction information for each of the nozzles 4, and storing the correction information in a nonvolatile memory in the recording head 3 when the recording head 3 is manufactured, for example. When the image forming apparatus 1 is activated, the controller 40 reads the correction information from the nonvolatile memory, and sets the correction information in the drive waveform correction information storage unit 35.

Alternatively, it may be possible to write the correction information on the recording head 3 to a nonvolatile memory in the controller 40 when the recording head 3 is assembled, and cause the controller 40 to read the correction information from the nonvolatile memory and set the correction information in the drive waveform correction information storage unit 35 when the image forming apparatus 1 is activated. In this case, the correction information on the recording head 3 may be stored in the nonvolatile memory in the recording head 3, or may be stored in a different storage device (for example, a storage device provided on the network) in association with information for identifying the recording head 3 such that the correction information is downloaded from (or read by connection to) the different storage device and written in the nonvolatile memory of the controller 40 when the recording head 3 is assembled. With this configuration, it is possible to obtain corresponding correction information when the recording head 3 is assembled (replaced), so that it is possible to assemble or replace the recording head 3 in a simple manner.

Further, it may be possible to change the correction information so as to correct deviation of the landing position due to relative deviation from the other recording heads 3 after the recording head 3 is assembled, and update the correction information stored in the nonvolatile memory in the recording head 3 with the changed correction information. By doing so, as illustrated in FIG. 1, it becomes possible to correct relative positional deviation between the recording heads 3 by the image forming apparatus 1 configured as a line-scanning-type inkjet recording device including a plurality of the recording heads 3. Therefore, it becomes possible to further improve the image quality in a simple manner.

As described above, in the embodiment, a plurality of the drive waveform generating units 33 are provided for the respective nozzles 4 provided on the recording head 3, and the corresponding drive waveform generating units 33 generate drive waveforms so as to correct variation in the ink droplet amount or the landing position caused by variation in the nozzles 4. Therefore, according to the embodiment, it is possible to set the ink droplet amount and the landing position of a droplet ejected from each of the nozzles 4 to a desired state in a relatively simple configuration, and it is possible to effectively prevent a reduction in the image quality due to variation in the nozzles 4.

Further, in the embodiment, unlike the conventional common drive waveform system (a system that selectively applies a necessary waveform portion to each of the piezoelectric elements by a switching element by using a single common drive waveform that is a combination of a plurality of drive waveform components for ejecting a plurality of types of ink droplets), it is possible to set drive waveforms for ejecting a plurality of types of ink droplets (for example, a large droplet, a medium droplet, and a small droplet) for the driving. Therefore, it is possible to optimize the drive waveform for each type of the ink droplet, so that it is possible to set more preferable ejection characteristics. Furthermore, it is possible to individually correct variation in the ink droplet amount and the landing position due to variation in the nozzles 4 for each type of the ink droplet. Therefore, it is possible to further improve the image quality.

The present invention may be defined as follows. Specifically, the head driving unit 30 (head driving device) of the embodiment is the head driving unit 30 that drives the recording head 3 including a plurality of the nozzles 4 and a plurality of the piezoelectric elements 5 corresponding to the respective nozzles 4, and includes a plurality of the drive waveform generating units 33 (33-1 to 33-N) corresponding to the respective piezoelectric elements 5 (5-1 to 5-N). The drive waveform generating units 33 drive the corresponding piezoelectric elements 5 on the basis of pieces of the drive waveform information that are set for the respective nozzles 4 so as to approximately equalize the ejection characteristics of the droplets ejected from the nozzles 4.

Further, the recording head unit of the embodiment is configured by integrating the above described head driving unit 30 with the recording head 3. Furthermore, the image forming apparatus 1 of the embodiment includes the above described recording head unit.

While the embodiment of the present invention has been described above, the present invention is not limited to the embodiment as it is. The present invention may be embodied by modifying or changing components within the scope and sprit of the invention. For example, modifications as described below may be possible.

First Modification

Figure 8:
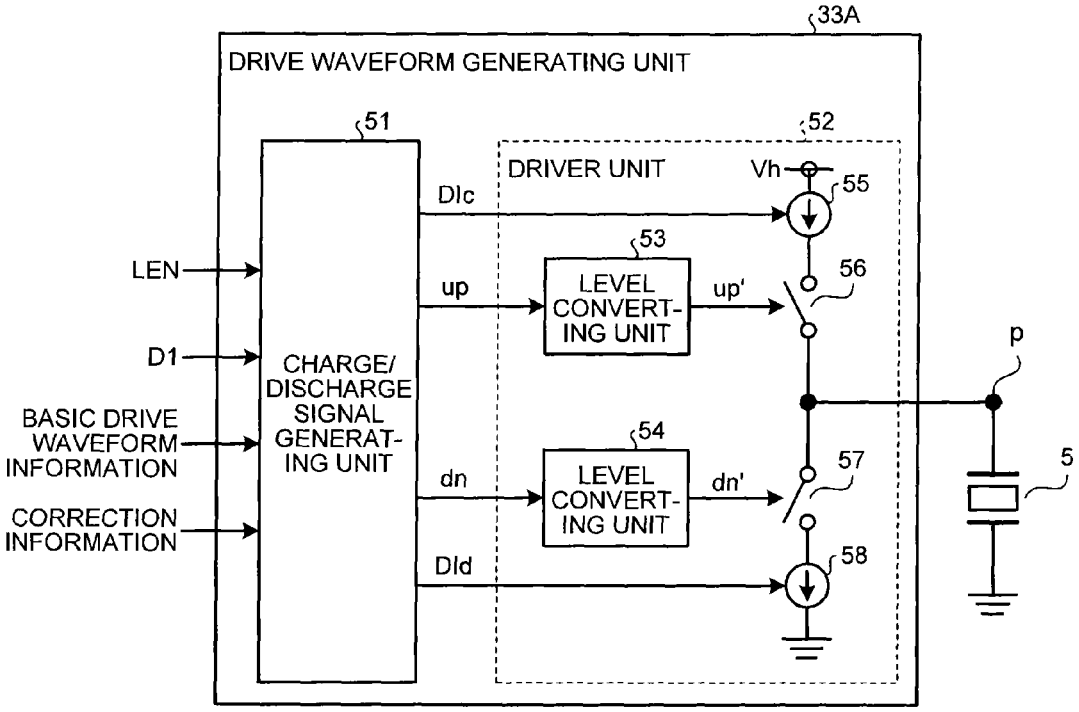
FIG. 8 is a diagram illustrating another configuration example of a drive waveform generating unit.

The drive waveform generating unit 33 included in the head driving unit 30 of the embodiment may be configured as illustrated in FIG. 8, for example. In the following, the drive waveform generating unit configured as illustrated in FIG. 8 is described as a drive waveform generating unit 33A for discrimination from the above described drive waveform generating unit 33.

The drive waveform generating unit 33A illustrated in FIG. 8 includes a charge/discharge signal generating unit 51 and a driver unit 52. The driver unit 52 has a circuit configuration including a constant current source 55 (first current source) and a first switch 56, which are connected in tandem to the power supply Vh and the point p on one end side of the piezoelectric element 5, and including a constant current source 58 (second current source) and a second switch 57, which are connected in tandem to the point p on one end side of the piezoelectric element 5 and the ground.

The charge/discharge signal generating unit 51, similarly to the charge/discharge signal generating unit 41 of the drive waveform generating unit 33 as described above, generates the charge signal up for controlling a charge timing and a charge duration of the piezoelectric element 5 and the discharge signal do for controlling a discharge timing and a discharge duration of the piezoelectric element 5, on the basis of the image data Di, the basic drive waveform information, the correction information, and the latch enable signal LEN serving as a reference for starting drive waveform generation. Further, the charge/discharge signal generating unit 51 supplies a setting signal DIc of a charge current value Ic to the constant current source 55, and supplies a setting signal DId of a discharge current value Id to the constant current source 58, as will be described later.

In the configuration as illustrated in FIG. 8, in a period in which the charge signal up is active, the first switch 56 is ON and the piezoelectric element 5 is charged to the voltage Vh of the power supply at the constant charge current value Ic. The charge current value Ic is set in accordance with the setting signal DIc supplied from the charge/discharge signal generating unit 51 to the constant current source 55. In contrast, in a period in which the discharge signal dn is active, the second switch 57 is ON and the piezoelectric element 5 is discharged to the ground at the constant discharge current value Id. The discharge current value Id is set in accordance with the setting signal DId supplied from the charge/discharge signal generating unit 51 to the constant current source 58. Further, similarly to the above described example, level converting units 53 and 54 convert the voltages of the charge signal up and the discharge signal dn to voltage levels at which the first switch 56 and the second switch 57 are turned on and off.

In the drive waveform generating unit 33A configured as described above, the current value at the time of discharge is controlled by the discharge current value Id, and the current value at the time of charge is controlled by the charge current value Ic; therefore, a charge/discharge speed is controlled as a constant speed. Specifically, it is possible to control the fall time tf* and the pulse wave peak value V* so as to reach desired values by changing the ON time of the discharge current value Id and the discharge signal dn, without repeating ON/OFF of discharge in the short cycle Tsw during the discharge period as performed by the drive waveform generating unit 33 as described above.

Figure 9:
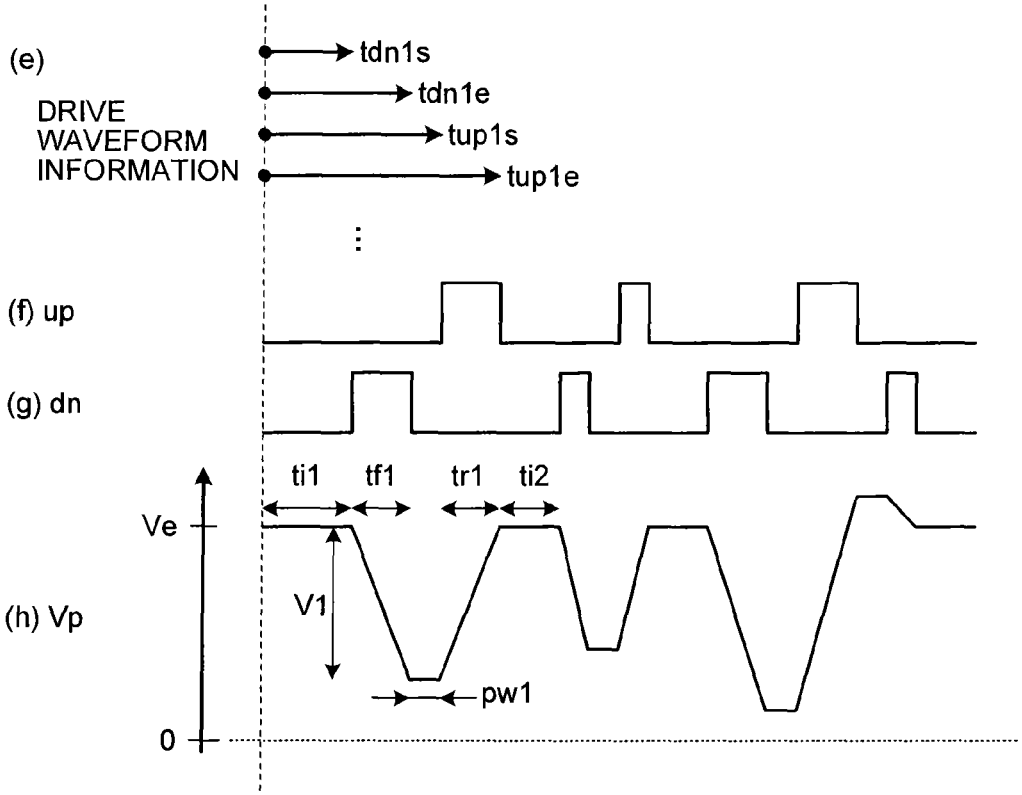
FIG. 9 is a diagram illustrating an example of a drive waveform generated by the drive waveform generating unit illustrated in FIG. 8.

FIG. 9 is a diagram illustrating an example of a drive waveform generated by the drive waveform generating unit 33A. Similarly to the example illustrated in FIG. 6, (e) indicates a part of the drive waveform information, (f) indicates the charge signal up, (g) indicates the discharge signal dn, and (h) indicates the drive voltage Vp applied to the piezoelectric element 5. In FIG. 9, a period in which the charge signal up indicated by (f) is ON serves as a charge period, and a period in which the discharge signal dn indicated by (g) is ON serves as a discharge period. In the first modification, the charge current value Ic and the discharge current value Id are controlled so as to be constant; therefore, the potential changes at an approximately constant rate in the charge period and the discharge period.

Meanwhile, the discharge current value Id, the fall time tf, and the pulse wave peak value V satisfy a relational expression (1) below. C is a capacitance value of the piezoelectric element 5.

$$Id=C\cdot V/tf \quad (1)$$

Similarly, the charge current value Ic, the rise time tr, and the pulse wave peak value V satisfy a relational expression (2) below.

$$Ic=C\cdot V/tr \quad (2)$$

Therefore, charge and discharge current values are individually set depending on variation in the capacitance value C, the pulse wave peak value V at which a desired ejection state is obtained, and rise/fall times.

According to the drive waveform generating unit 33A of the first modification, it is not necessary to switch between the first switch 56 used for charge and the second switch 57 used for discharge at a high frequency; therefore, it is possible to reduce power consumption as compared to the above described drive waveform generating unit 33. Meanwhile, even in the drive waveform generating unit 33A of the first modification, it may be possible to change the charge current value and the discharge current value by controlling ON/OFF of discharge (or charge) similarly to the example illustrated in FIG. 6, and control the pulse wave peak value V and rise/fall times.

Second Modification

Figure 10:
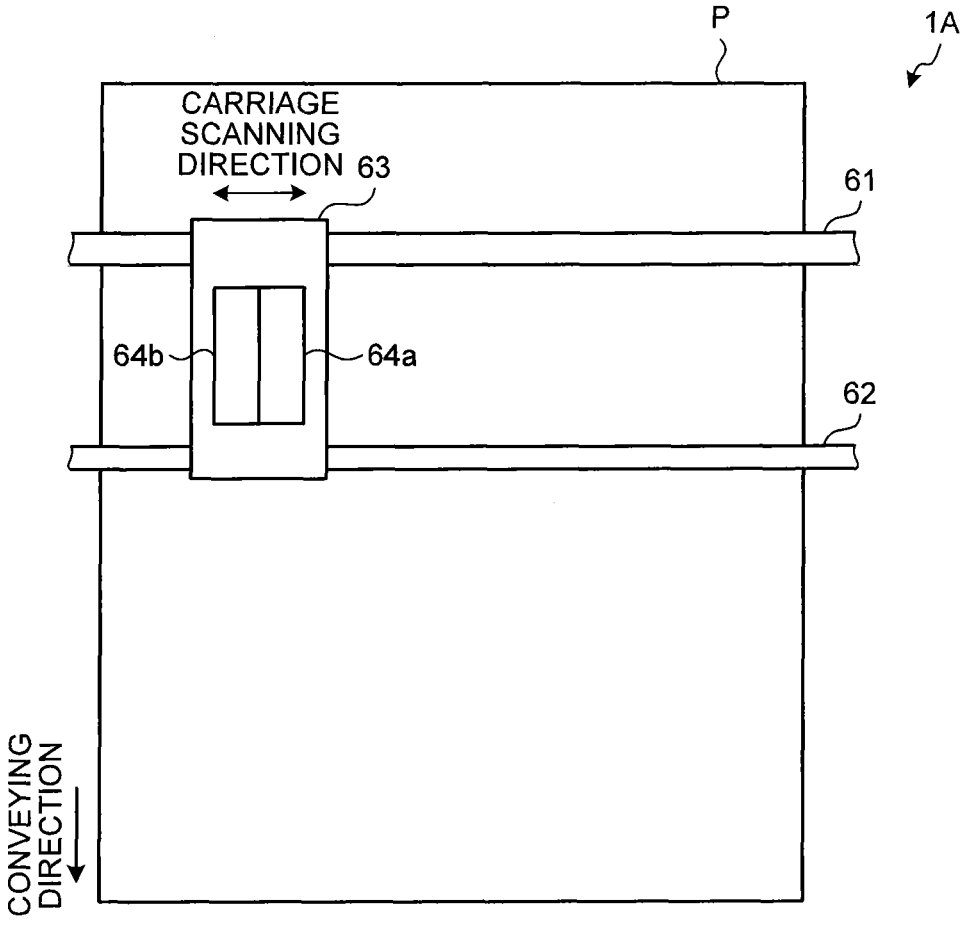
FIG. 10 is a diagram for explaining another configuration example of the image forming apparatus of the embodiment.

The image forming apparatus 1 of the embodiment may be configured as a serial-type inkjet recording device as illustrated in FIG. 10, for example. In the following, the image forming apparatus configured as illustrated in FIG. 10 is described as an image forming apparatus 1A for discrimination from the image forming apparatus 1 (see FIG. 1) that is configured as a line-scanning-type inkjet recording device as described above.

The image forming apparatus 1A includes, as illustrated in FIG. 10, a carriage 63 that is supported by guide rods 61 and 62, which are laterally bridged on right and left side plates of an apparatus main body, such that the carriage 63 is able to slide in a direction (main-scanning direction) perpendicular to the conveying direction of the recording medium P. The carriage 63 receives a driving force from a main scanning motor (not illustrated) via a timing belt, and moves for scanning in a carriage scanning direction indicated by a double-headed arrow illustrated in FIG. 10. Recording heads 64*a* and 64*b* for ejecting ink droplets of different colors of yellow (Y), cyan (C), magenta (M), and black (K) are mounted on the carriage 63. Each of the recording heads 64*a* and 64*b* includes, similarly to the above described recording head 3, a nozzle array formed of a plurality of nozzles, and a pressure generating means such as a piezoelectric element, and is mounted on the carriage 63 such that the nozzle array is arranged along a direction perpendicular to the main-scanning direction and an ink ejection surface faces the recording medium P side.

Each of the recording heads 64*a* and 64*b* includes two nozzle arrays, for example. One of the nozzle arrays on the recording head 64*a* ejects ink droplets of black (K), and the other one of the nozzle arrays ejects ink droplets of cyan (C). Further, one of the nozzle arrays of the recording head 64*b* ejects ink droplets of magenta (M), and the other one of the nozzle arrays ejects ink droplets of yellow (Y). The image forming apparatus 1A drives the recording heads 64*a* and 64*b* in accordance with an image signal while moving the carriage 63 and ejects ink droplets to the recording medium P in a state of being stopped to perform recording of a single sweep of scanning. The image forming apparatus 1A subsequently conveys the recording medium P by a predetermined amount, and thereafter records a next line. The internal configurations of the recording heads 64*a* and 64*b* are the same as the internal configuration of the recording head 3 as illustrated in FIG. 3. Incidentally, similarly to the above described image forming apparatus 1, the drawings and detailed explanation of components of the image forming apparatus 1A, such as the mechanism for controlling the conveyance of the recording medium P, that are not directly related to the gist of the embodiment are omitted.

Even in the image forming apparatus 1A configured as described above, if the head driving unit 30 of the above described embodiment is provided and the head driving unit 30 is configured to drive the recording heads 64*a* and 64*b*, it is possible to obtain the same advantageous effects as those of the above described image forming apparatus 1. Specifically, in the configuration in which a plurality of the drive waveform generating units 33 corresponding to the respective nozzles 4 on the recording heads 64*a* and 64*b* are provided, and the corresponding drive waveform generating units 33 generate drive waveforms so as to correct variation in the ink droplet amount or the landing position due to variation in the nozzles 4, it is possible to set the ink droplet amount or the landing position of ink ejected from each of the nozzles to a desired state with a relatively simple configuration. Therefore, it is possible to effectively prevent a reduction in the image quality due to variation in the nozzles 4.

According to an embodiment of the present invention, it is possible to precisely reduce variation in the ink droplet amount or the landing position for each nozzle due to manufacturing variation, enabling to prevent a reduction in image quality.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A head driving device that drives a recording head including a plurality of nozzles and a plurality of pressure generating elements corresponding to respective nozzles, the head driving device comprising:

circuitry configured to:

drive respective pressure generating elements based on pieces of drive waveform information that are set for the respective nozzles so as to approximately equalize ejection characteristics of droplets ejected from the respective nozzles;

generate a charge signal and a discharge signal based on the pieces of drive waveform information; and convert voltages of the charge signal and the discharge signal to respective voltage levels at which a first switch and a second switch are turned on and off.

2. The head driving device according to claim 1, wherein the circuitry is configured to:

generate the charge signal for controlling a charge timing and a charge duration, and the discharge signal for controlling a discharge timing and a discharge duration with respect to a corresponding one of the pressure generating elements, and charge and discharge the corresponding one of the pressure generating elements based on the charge signal and the discharge signal, and wherein the drive waveform information is information for determining an ON/OFF timing of the charge signal and the discharge signal.

3. The head driving device according to claim 2, further comprising:

the first switch that is connected to the corresponding one of the pressure generating elements and a power supply for supplying power to the corresponding one of the pressure generating elements, and that enters an ON state in accordance with the charge signal; and the second switch that is connected to the corresponding one of the pressure generating elements and ground, and that enters an ON state in accordance with the discharge signal.

4. The head driving device according to claim 2, further comprising:

a first current source for supplying a charge current, the first current source and the first switch that enters an ON state in accordance with the charge signal are connected in tandem to the corresponding one of the pressure generating elements and a power supply for supplying power to the corresponding one of the pressure generating elements; and a second current source for supplying a discharge current, the second current source and the second switch that enters an ON state in accordance with the discharge signal are connected in tandem to the corresponding one of the pressure generating elements and ground.

5. The head driving device according to claim 4, wherein a value of the charge current supplied by the first current source and a value of the discharge current supplied by the second current source are changeable, and each piece of the drive waveform information contains the value of the charge current and the value of the discharge current.

6. The head driving device according to claim 1, further comprising:

a basic drive waveform information memory that stores therein a piece of basic drive waveform information for determining a representative value of the ejection characteristics of the droplets ejected from the respective nozzles; and a drive waveform correction information memory that stores therein pieces of correction information that are set in advance for the respective nozzles to correct the basic drive waveform information so as to approximately equalize the ejection characteristics of the droplets ejected from the respective nozzles, wherein each piece of the drive waveform information is determined based on the basic drive waveform information and a corresponding piece of the correction information.

7. The head driving device according to claim 6, wherein the basic drive waveform information memory stores therein a plurality of pieces of the basic drive waveform information corresponding to different sizes of droplets to be ejected, and the circuitry is configured to select a piece of the basic drive waveform information used to determine a piece of the drive waveform information from among the pieces of the basic drive waveform information in accordance with a size of a droplet to be ejected from a corresponding one of the nozzles.

8. The head driving device according to claim 7, wherein the drive waveform correction information memory stores therein at least a part of each piece of the correction information for each of the nozzles in accordance with each size of the droplet to be ejected, and the circuitry is configured to select a piece of the correction information used to determine the piece of the drive waveform information from among the pieces of the correction information in accordance with the size of the droplet to be ejected from the corresponding one of the nozzles.

9. The head driving device according to claim 6, wherein the basic drive waveform information memory stores therein a plurality of pieces of the basic drive waveform information corresponding to temperatures of droplets, and the circuitry is configured to select a piece of the basic drive waveform information used to determine a piece of the drive waveform information from among the pieces of the basic drive waveform information in accordance with a detected temperature of a droplet.

10. The head driving device according to claim 6, further comprising:

a nonvolatile memory for storing the pieces of the correction information, wherein each piece of the correction information is written in the nonvolatile memory when the recording head is manufactured.

11. A recording head apparatus comprising:

the head driving device according to claim 1, wherein the head driving device and the recording head are integrated with each other.

12. An image forming apparatus comprising the recording head apparatus according to claim 11.

* * * * *